US010189633B2

(12) United States Patent
Fath

(10) Patent No.: US 10,189,633 B2
(45) **Date of Patent: *Jan. 29, 2019**

(54) LIGHTER HOLDER FOR CIGARETTE AND CIGAR PACKS

(71) Applicant: ALTRIA CLIENT SERVICES LLC, Richmond, VA (US)

(72) Inventor: Scott A. Fath, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/996,087

(22) Filed: Jun. 1, 2018

(65) Prior Publication Data

US 2018/0273283 A1 Sep. 27, 2018

Related U.S. Application Data

(63) Continuation of application No. 14/469,195, filed on Aug. 26, 2014, now Pat. No. 10,011,420.

(51) Int. Cl.

| | |
|---|---|
| ***A24F 15/00*** | (2006.01) |
| ***A24F 27/00*** | (2006.01) |
| ***B65D 85/10*** | (2006.01) |
| ***B65D 85/12*** | (2006.01) |

(52) U.S. Cl.
CPC ..... *B65D 85/109* (2013.01); *A24F 15/00* (2013.01)

(58) Field of Classification Search
CPC . A24D 1/08; A24F 15/18; A24F 15/00; A24F 27/00; B65D 85/109; B65D 85/10; B65D 85/12
USPC ..... 206/85–87, 89, 93–95, 102, 107, 119; 220/62, 62.1, 737
See application file for complete search history.

(56) References Cited

U.S. PATENT DOCUMENTS

| | | | | |
|---|---|---|---|---|
| 1,982,855 | A | 12/1934 | Brunner et al. | |
| 3,241,738 | A | 3/1966 | Freiman | |
| 3,343,746 | A | 9/1967 | Shiffman | |
| 3,866,747 | A | 2/1975 | Scholz | |
| 4,252,237 | A | 2/1981 | Baclit | |
| 4,588,076 | A | 5/1986 | Caputo et al. | |
| 4,750,613 | A | 6/1988 | Kopp | |
| 4,852,729 | A | 8/1989 | Conte | |
| 5,088,684 | A | 2/1992 | Torras et al. | |
| 5,368,155 | A | 11/1994 | Ewen | |
| 5,386,910 | A | 2/1995 | Liss | |
| 5,558,217 | A | 9/1996 | Focke et al. | |
| 5,630,503 | A | 5/1997 | Rhodes et al. | |
| 5,918,734 | A | 7/1999 | Devens et al. | |
| 6,119,852 | A * | 9/2000 | Focke | B65D 85/109 206/102 |

(Continued)

OTHER PUBLICATIONS

Photo, Date: Unknown Author: Unknown.

*Primary Examiner* — Rafael A Oritz
(74) *Attorney, Agent, or Firm* — Harness, Dickey & Pierce, P.L.C.

(57) ABSTRACT

A lighter holder for a cigarette or cigar package, comprising a substantially rectangular member foldable into the lighter holder, the rectangular member having a length and a width and five discrete panels defined in the length direction by foldable score lines in the width direction, the second and fourth panels being internally foldable and having apertures at corresponding locations in the width directions thereof.

9 Claims, 2 Drawing Sheets

(56) References Cited

U.S. PATENT DOCUMENTS

| | | | | |
|---|---|---|---|---|
| 6,223,891 | B1 * | 5/2001 | Devens | A24F 15/18 206/102 |
| 6,693,850 | B2 | 2/2004 | Mulaw | |
| 6,892,877 | B2 | 5/2005 | Shurman | |

* cited by examiner

LIGHTER HOLDER FOR CIGARETTE AND CIGAR PACKS

CROSS-REFERENCE TO RELATED APPLICATIONS

This application is a continuation of U.S. patent application Ser. No. 14/469,195, filed Aug. 26, 2014, the entire teachings of which are hereby incorporated by reference.

BACKGROUND

Field

Disclosed herein is an easily manufactured and mounted lighter holder provided as an insert, onsert or outsert for cigarette and cigar packs.

Environment

Cigarettes are sold in shirt pocket sized rectilinear retail containers or "packs" containing twenty cigarettes. The well known cigarette pack comprises an inner foil sheet that surrounds the cigarettes, a glued paper structural layer that forms the container, and a snugly wrapped outer layer of cellophane. In so-called soft packs the structural layer is flexible paper; the cellophane is removable around the top edge of the pack; and the foil is intended to be torn away over a limited portion of the top adjacent to a seal strip. In so-called hard packs the structural layer is paperboard; the cellophane is removable below a fold-back lid that extends part way down the sidewalls; and an inserted foil portion can be pulled away to expose the top ends of the cigarettes. Whether hard pack or soft pack, the structural layer is formed of sheet material that has been cut, folded and glued to form the pack.

A smoker must also carry a lighter or a book of matches to ignite the cigarettes. A popular option that has become standard is the disposable butane lighter, which frequently is dimensioned to have a height and width substantially the same as the height and thickness of a cigarette pack. A common annoyance occasionally experienced by cigarette smokers is the misplacement of their cigarette lighter. To reduce the possibility that the lighter will be misplaced, the lighter can be carried commonly with the cigarettes, for example inside the pack after a sufficient number of cigarettes have been removed to clear a space. Similarly, it is known in the art to provide a rigid cigarette pack holder, carrier or caddy that attaches to a pack of cigarettes or has a receptacle to receive the pack, and also has a receptacle for a cigarette lighter.

Cigarette pack and lighter caddies are advantageous in that they keep the pack and the lighter associated, but require that the smoker carry an additional piece of smoking paraphernalia. Thus, it is nearly as easy to misplace a caddy (particularly when empty) as to misplace a lighter. Additionally, many pack/lighter caddies are bulky, making them less than desirable for carrying in a smoker's pocket or purse. It would be advantageous if a more convenient and inexpensive way could be provided for smokers to carry their cigarette lighters along with their cigarette packs, without having to purchase and retain a separate carrier device.

However, despite recent advances, there remains an unmet need in the art to provide a simply-produced lighter holder for cigarette and cigar packs.

SUMMARY

In one aspect, provided is a lighter holder for a cigarette or cigar package, comprising a substantially rectangular member foldable into the lighter holder, the rectangular member having a length and a width and five discrete panels defined in the length direction by foldable score lines in the width direction, the second and fourth panels being internally foldable and having apertures at corresponding locations in the width directions thereof.

In another form, the lighter holder has first, third and fifth panels structured and arranged to be folded into an overlapping relationship, the first panel having an adhesive on one surface thereof enabling it to adhere to one surface of the fifth panel.

In another form, the fifth panel is folded to form a back of the lighter holder and has at least one strip of adhesive, such as two-sided tape, disposed in the width direction of the rectangular paperboard.

Additionally, the rectangular member is folded so the first and fifth panels overlap to form an inner wall of the lighter holder, the third panel forms an outer wall opposite the inner wall, the second and fourth panels are folded outward of the lighter holder to form side walls, and the apertures coact to form an inwardly-folded bottom ledge for supporting a lighter.

In one form, the five discrete panels are of equal length, and the apertures are pentagonal.

In other forms, the rectangular member is paperboard or plastic.

In another aspect, provided is a lighter holder provided as an insert, onsert or outsert on a cigarette or cigar package, comprising a substantially rectangular member having a length, a width and first and second opposing surfaces, comprising first, second, third, fourth and fifth widthwise panels having widthwise, foldable score lines between the first, second, third, fourth and fifth panels for folding the panels; additional widthwise score lines in both the second and fourth widthwise panels; and apertures having at least one lengthwise edge in each of the second and fourth widthwise panels, between the score lines and near similar lengthwise edges of each of the second and fourth panels.

Advantageously, the first, third and fifth widthwise panels are structured and arranged to be folded into an overlapping relationship, the first panel having an adhesive on the first surface thereof for adhering it to the second surface of the fifth panel.

In one form, the fifth panel has at least one strip of adhesive on the first surface thereof, such as a two-sided adhesive tape.

In another form, the rectangular member is folded such that the first and fifth widthwise panels overlap to form an inner wall of the lighter holder, the third widthwise panel forms an outer wall opposite the inner wall, the second and fourth widthwise panels are folded outward of the lighter holder to form side walls, and the apertures coact to form an inwardly-folded bottom ledge for supporting a lighter.

Preferably, the widthwise panels are of equal length, and the apertures are pentagonal.

In other forms, the rectangular member is paperboard or plastic.

In yet another aspect, provided is a cigarette or cigar pack comprising an insert, onsert or outsert lighter holder, which comprises a substantially rectangular member having a length, a width and first and second opposing surfaces, having first, second, third, fourth and fifth widthwise panels having foldable widthwise score lines between the first, second, third, fourth and fifth panels for folding the panels; additional widthwise score lines in both the second and fourth widthwise panels; and apertures having at least one lengthwise edge in each of the second and fourth widthwise panels, between the score lines and near similar lengthwise edges of each of the second and fourth panels.

According to this form, the substantially rectangular member has the first, third and fifth widthwise panels folded into an overlapping relationship to form a rectangular portion of the lighter holder, and the second and fourth widthwise panels are folded outward at the additional widthwise score lines, forming wing-like portions which extend outwardly from the rectangular portion.

In still yet another aspect, provided is a method of forming a lighter holder for inclusion as an insert, onsert or outsert to a cigarette or cigar package. The method includes the steps of forming a substantially rectangular member having a length, a width and first and second opposing surfaces, the substantially rectangular member including a first, second, third, fourth and fifth widthwise panels having widthwise, foldable score lines between the first, second, third, fourth and fifth panels for folding the panels; additional widthwise score lines in both the second and fourth widthwise panels; and apertures having at least one lengthwise edge in each of the second and fourth widthwise panels, between the score lines and near similar lengthwise edges of each of the second and fourth panels; folding the first, third and fifth widthwise panels into an overlapping relationship, the first panel having an adhesive on a first surface thereof; and adhering the first surface of the first panel to the second surface of the fifth panel.

BRIEF DESCRIPTION OF THE DRAWINGS

The forms disclosed herein are illustrated by way of example, and not by way of limitation, in the figures of the accompanying drawings and in which like reference numerals refer to similar elements and in which.

DETAILED DESCRIPTION

Figure 1:
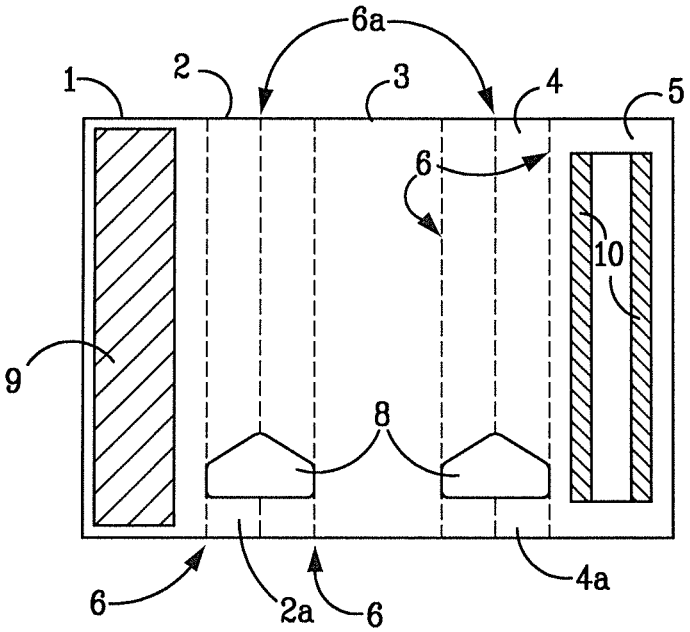
FIG. 1 illustrates a flat view of the rectangular sheet, identifying the relative locations of the various elements of the lighter holder as manufactured.

Described herein is a process for producing a butane lighter holder provided as an insert, onsert or outsert for a cigarette or cigar pack.

Each of the following terms written in singular grammatical form: "a," "an," and "the," as used herein, may also refer to, and encompass, a plurality of the stated entity or object, unless otherwise specifically defined or stated herein, or, unless the context clearly dictates otherwise. For example, the phrases "a device," "an assembly," "a mechanism," "a component," and "an element," as used herein, may also refer to, and encompass, a plurality of devices, a plurality of assemblies, a plurality of mechanisms, a plurality of components, and a plurality of elements, respectively.

Each of the following terms: "includes," "including," "has," "having," "comprises," and "comprising," and, their linguistic or grammatical variants, derivatives, and/or conjugates, as used herein, means "including, but not limited to."

Throughout the illustrative description, the examples, and the appended claims, a numerical value of a parameter, feature, object, or dimension, may be stated or described in terms of a numerical range format. It is to be fully understood that the stated numerical range format is provided for illustrating implementation of the forms disclosed herein, and is not to be understood or construed as inflexibly limiting the scope of the forms disclosed herein.

Moreover, for stating or describing a numerical range, the phrase "in a range of between about a first numerical value and about a second numerical value," is considered equivalent to, and means the same as, the phrase "in a range of from about a first numerical value to about a second numerical value," and, thus, the two equivalently meaning phrases may be used interchangeably.

It is to be understood that the various forms disclosed herein are not limited in their application to the details of the order or sequence, and number, of steps or procedures, and sub-steps or sub-procedures, of operation or implementation of forms of the method or to the details of type, composition, construction, arrangement, order and number of the system, system sub-units, devices, assemblies, sub-assemblies, mechanisms, structures, components, elements, and configurations, and, peripheral equipment, utilities, accessories, and materials of forms of the system, set forth in the following illustrative description, accompanying drawings, and examples, unless otherwise specifically stated herein. The apparatus, systems and methods disclosed herein can be practiced or implemented according to various other alternative forms and in various other alternative ways.

It is also to be understood that all technical and scientific words, terms, and/or phrases, used herein throughout the present disclosure have either the identical or similar meaning as commonly understood by one of ordinary skill in the art, unless otherwise specifically defined or stated herein. Phraseology, terminology, and, notation, employed herein throughout the present disclosure are for the purpose of description and should not be regarded as limiting.

According to the present invention, a paper or plastic sheet that is folded twice and glued together that lays flat, but can be erected to form a lighter holder is provided. The flat (collapsed) holder can be inserted into the packs of cigarettes or cigars when being made (inserts), or attached to the back of the packs (onserts) before or after wrapping (outserts) with film. There is a section of adhesive, such as a piece of double-sided adhesive tape that allows the lighter holder to be easily aligned with and attached to the cigarette or cigar pack before the holder is erected.

Advantageously, the lighter holder can be made of a single rectangular sheet of for example 12 point SBS paper or clear PET film that can be printed as desired. The item is perforated along predefined foldable score lines provided in the width direction of the rectangular sheet such that it lays flat for shipping, but can be erected into a three dimensional holder for a conventional butane lighter.

The flat, shippable item can be attached with fugitive glue between the back of the pack and the overlying film as an onsert, or attached with fugitive glue to the film on the back of the package as an outsert, or even just slipped into the pack.

The portion of the folded panel 5 configured to be the backside of the three dimensional lighter holder has an adhesive provided thereon, such as for example a strip of double sided adhesive tape, to allow consumers to attach the lighter holder where they choose, such as on the side of the cigarette or cigar pack.

One distinct advantage in producing the disclosed item is that the scored, foldable panels are defined to be of equal width, which facilitates manufacture on conventional machinery and separate from the cigarette or cigar packs themselves, which avoids redesign of those packages to accommodate the lighter holder. As such, production of the folded lighter holders can be separately conducted or contracted from production of the cigarette or cigar packs, if desired.

According to this form, the backside of the folded, three-dimensional lighter holder has overlapping first and fifth panels which can be glued together in the flattened, shippable state, such that when opened, a solid back-panel having a width similar-to or the same as the cigarette or cigar pack, is defined for adhesion to the side of the cigarette or cigar pack, simplifying alignment of the cooperating portions of the lighter holder with the cigarette or cigar pack for the consumer/user.

Scoring of the foldable lines can be accomplished by simply compressing the lines relative to the remainder of the rectangular surface or by perforation of the lines, either method providing a score line weakened relative to the remaining material of the rectangular sheet, facilitating folding at the appropriate locations.

According to FIG. 1, a rectangular sheet of paperboard or plastic is divided into five, preferably equal length panels 1-5, defined in the length direction of the rectangular sheet by widthwise score lines 6, adapted for folding. Notably, both of panel 2 and panel 4 are further subdivided, preferably bi-furcated with additional score lines 6*a*, the utility of which will be discussed below. Items 2*a* and 4*a*, each having lengthwise edges 2*b* and 4*b*, respectively, are adapted to form a lower ledge for limiting the vertical travel of a lighter, such as a butane lighter, to be inserted into the finished, folded and expanded lighter holder. Items 8 are geometrical apertures in panels 2 and 4, each having at least one lengthwise edge 8*a*, which coact with items 2*a* and 4*a* to form lower ledges for retaining the inserted lighter. First panel 1 has provided on a first surface thereof a strip of adhesive, which when the rectangular sheet is folded onto itself in the appropriate manner, provides an adhesive surface for adhesion to a second surface of panel 5. Panel 5 has a strip of adhesive 10 on the first surface thereof, such as for example a strip of two-sided adhesive tape, the outer surface of which can be protected by a release film or paper, as is known in the art.

The shape of geometrical apertures can vary and can be essentially pentangular as illustrated herein. However, even half-moon shaped apertures could be used, having one straight edge and a semicircular coacting edge. Accordingly, even triangular, rectangular or other multi-sided apertures would be effective, so long as at least one straight edge is provided in the length direction to act as the lower ledge of the holder for retaining the lighter.

Figure 2:
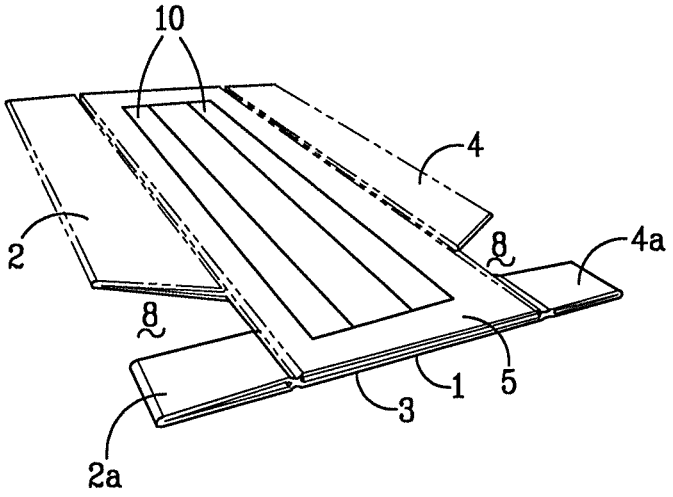
FIG. 2 illustrates a finished folded view of the lighter holder as manufactured and intended for inclusion with the cigarette or cigar pack.

FIG. 2 illustrates a finished, flat version of the lighter holder suitable for inclusion with a cigarette or cigar pack as an insert, onsert or outsert. In this view, the rectangular sheet according to FIG. 1 is folded back on itself such that each panel is folded along its corresponding fold lines 6 back into the direction of the illustration. The adhesive (first) surface 9 of panel 1 is folded into adhering contact with the back (second) surface of panel 5. The foldable score lines 6*a* provided in the middle of panels 2 and 4 are folded in the opposite direction from score lines 6, such that when folding is completed the flat structure of FIG. 2 results and panels 1, 3 and 5 overlap, forming a rectangular portion of the flattened holder. Bifurcated panels 2 and 4 extend in a wing-like fashion from the rectangular portion comprised of overlapping panels 1, 3 and 5, with lower ledges 2*a* and 4*a*, separated from the rest of panels 2 and 4 by apertures 8, also extending in a wing-like fashion from the flattened holder. In this FIG. 2, the first surface of panel 5 is on top, demonstrating the location of two-sided adhesive 10.

Figure 3:
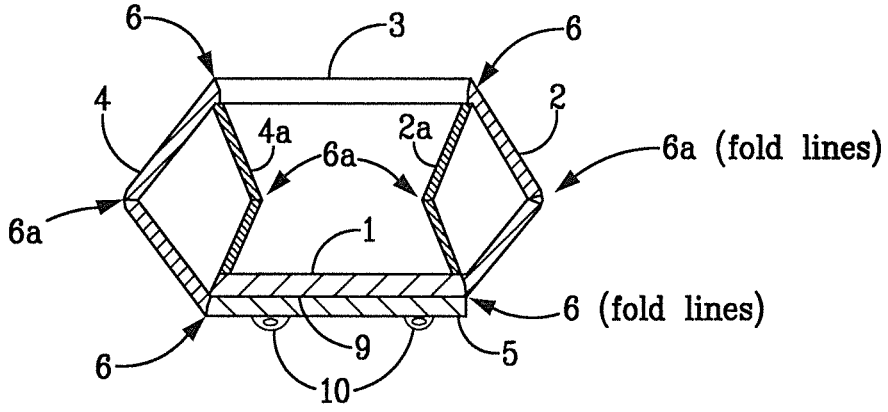
FIG. 3 illustrates an expanded, three dimensional view from the top of the lighter holder.

FIG. 3 illustrates an overhead or top view of the expanded lighter holder, which in this view is essentially hexagonal. In this view the overlapping relationship of panels 1 and 5 can be seen, such that a first surface of panel 1 is adhered through adhesive 9 (not shown in this figure) to a second surface of panel 5. Expansion of the holder into a three-dimensional form is accomplished by pulling panel 3 away from overlapped and adhered panels 1, 5 by virtue of bifurcated panels 2 and 4, with score lines 6*a* acting as hinges. On the bottom of the structure, ledges 2*a* and 4*a* are folded inwardly to provide supporting ledges for the lighter to be inserted and held therein. Adhesive strips 10, here illustrated as separated strips, but which could be a single, broad strip, are disposed on the first surface of panel 5 for contact adhesion to a side of a cigarette or cigar pack. As would be apparent to the skilled artisan, the overlapping relationship of panels 1 and 5 forms a single adhesive surface to be applied to the cigarette or cigar pack, facilitating parallel alignment with the sides of the cigarette or cigar pack by the consumer. In contrast, a lighter holder according to U.S. Pat. No. 6,223,891, which has split adhering panels 62 requiring separate positioning and adherence, can be difficult to properly align with the side of a cigarette pack 35 and can result in an unwieldy combination for pocket or purse storage.

Figure 4:
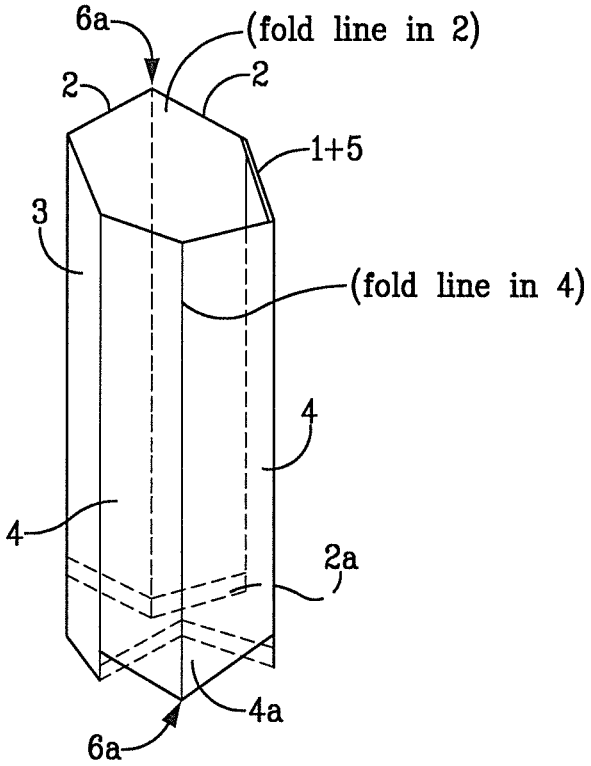
FIG. 4 illustrates an expanded, three dimensional plan view of the lighter holder.

FIG. 4 illustrates a plan view of the expanded-for-use lighter holder of the present invention, again illustrating the overlapping relationship of end panels 1 and 5, the outwardly extending relationship of bifurcated panels 2 and 4 and the inwardly extending relationship of lower ledges 4*a* and 2*a* (shown in phantom) for supporting the lighter to be inserted into the holder.

In another aspect, provided is a method of forming a lighter holder for inclusion as an insert, onsert or outsert to a cigarette or cigar package. The method includes the steps of forming a substantially rectangular member having a length, a width and first and second opposing surfaces, the substantially rectangular member including a first, second, third, fourth and fifth widthwise panels having widthwise, foldable score lines between the first, second, third, fourth and fifth panels for folding the panels; additional widthwise score lines in both the second and fourth widthwise panels; and apertures having at least one lengthwise edge in each of the second and fourth widthwise panels, between the score lines and near similar lengthwise edges of each of the second and fourth panels; folding the first, third and fifth widthwise panels into an overlapping relationship, the first panel having an adhesive on a first surface thereof; and adhering the first surface of the first panel to the second surface of the fifth panel.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

Illustrative, non-exclusive examples of apparatus and methods according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

PCT1. A lighter holder for a cigarette or cigar package, comprising a substantially rectangular member foldable into the lighter holder, the rectangular member having a length and a width and five discrete panels defined in the length direction by foldable score lines in the width direction, the second and fourth panels being internally foldable and having apertures at corresponding locations in the width directions thereof.

PCT2. The lighter holder of paragraph PCT1, wherein the first, third and fifth panels are structured and arranged to be folded into an overlapping relationship, the first panel having an adhesive on one surface thereof enabling it to adhere to one surface of the fifth panel.

PCT3. The lighter holder of paragraphs PCT1 or PCT2, wherein the fifth panel is folded to form a back of the lighter holder and has at least one strip of adhesive disposed in the width direction of the rectangular paperboard.

PCT4. The lighter holder of paragraphs PCT1-PCT3, wherein the rectangular member is folded so the first and fifth panels overlap to form an inner wall of the lighter holder, the third panel forms an outer wall opposite the inner wall, the second and fourth panels are folded outward of the lighter holder to form side walls, and the apertures coact to form an inwardly-folded bottom ledge for supporting a lighter.

PCT5. The lighter holder of paragraphs PCT1-PCT4, wherein the five discrete panels are of equal length.

PCT6. The lighter holder of paragraphs PCT1-PCT5, wherein the apertures are pentagonal.

PCT7. The lighter holder of paragraphs PCT1-PCT6, wherein the rectangular member is paperboard.

PCT8. The lighter holder of paragraphs PCT1-PCT7, wherein the rectangular member is plastic.

PCT9. The lighter holder of paragraph PCT3, wherein the strip of adhesive is two-sided adhesive tape.

PCT10. A lighter holder provided as an insert, onsert or outsert on a cigarette or cigar package, comprising a substantially rectangular member having a length, a width and first and second opposing surfaces, comprising: first, second, third, fourth and fifth widthwise panels having widthwise, foldable score lines between the first, second, third, fourth and fifth panels for folding the panels; additional widthwise score lines in both the second and fourth widthwise panels; and apertures having at least one lengthwise edge in each of the second and fourth widthwise panels, between the score lines and near similar lengthwise edges of each of the second and fourth panels.

PCT11. The lighter holder of paragraph PCT10, wherein the first, third and fifth widthwise panels are structured and arranged to be folded into an overlapping relationship, the first panel having an adhesive on the first surface thereof for adhering it to the second surface of the fifth panel.

PCT12. The lighter holder of paragraph PCT11, wherein the fifth panel has at least one strip of adhesive on the first surface thereof.

PCT13. The lighter holder of paragraph PCT12, wherein the adhesive is two-sided adhesive tape.

PCT14. The lighter holder of paragraphs PCT10-PCT13, wherein the rectangular member is folded such that the first and fifth widthwise panels overlap to form an inner wall of the lighter holder, the third widthwise panel forms an outer wall opposite the inner wall, the second and fourth widthwise panels are folded outward of the lighter holder to form side walls, and the apertures coact to form an inwardly-folded bottom ledge for supporting a lighter.

PCT15. A cigarette or cigar pack comprising: an insert, onsert or outsert lighter holder, comprising a substantially rectangular member having a length, a width and first and second opposing surfaces, and having: first, second, third, fourth and fifth widthwise panels having widthwise score lines between the first, second, third, fourth and fifth panels for folding the panels; additional widthwise score lines in both the second and fourth widthwise panels; and apertures having at least one lengthwise edge in each of the second and fourth widthwise panels, between the score lines and near similar lengthwise edges of each of the second and fourth panels.

PCT16. The cigarette or cigar pack of paragraph PCT15, wherein the substantially rectangular member has the first, third and fifth widthwise panels folded into an overlapping relationship to form a rectangular portion of the lighter holder, and the second and fourth widthwise panels are folded outward at the additional widthwise score lines, forming wing-like portions which extend outwardly from the rectangular portion.

PCT17. A method of forming a lighter holder for inclusion as an insert, onsert or outsert to a cigarette or cigar package, comprising the steps of: (a) forming a substantially rectangular member having a length, a width and first and second opposing surfaces, the substantially rectangular member including a first, second, third, fourth and fifth widthwise panels having widthwise, foldable score lines between the first, second, third, fourth and fifth panels for folding the panels; additional widthwise score lines in both the second and fourth widthwise panels; and apertures having at least one lengthwise edge in each of the second and fourth widthwise panels, between the score lines and near similar lengthwise edges of each of the second and fourth panels; and (b) folding the first, third and fifth widthwise panels into an overlapping relationship, the first panel having an adhesive on a first surface thereof; and (c) adhering the first surface of the first panel to the second surface of the fifth panel.

PCT18. The method of paragraph PCT17, wherein the fifth panel has at least one strip of adhesive on the first surface thereof.

PCT19. The method of paragraph PCT18, wherein the adhesive is a two-sided adhesive tape.

PCT20. The method of paragraph PCT18 or PCT19, wherein the rectangular member is folded such that the first and fifth widthwise panels overlap to form an inner wall of the lighter holder, the third widthwise panel forms an outer wall opposite the inner wall, the second and fourth widthwise panels are folded outward of the lighter holder to form side walls, and the apertures coact to form an inwardly-folded bottom ledge for supporting a lighter.

INDUSTRIAL APPLICABILITY

The containers and processes disclosed herein are applicable to the consumer products industry.

It is believed that the disclosure set forth above encompasses multiple distinct inventions with independent utility. While each of these inventions has been disclosed in its preferred form, the specific forms thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

I claim:

1. A cigarette or cigar package, comprising:
- a container;
- a film wrapped around the container; and
- a lighter holder positioned inside the container, between the container and the film, or outside the film, said lighter holder comprising:
  - a substantially rectangular sheet comprising:
    - a length;
    - a width;
    - five discrete panels defined by foldable score lines, the five discrete panels including a first panel, a second panel, a third panel, a fourth panel, and a fifth panel, wherein the second panel and the fourth panel of the five panels are additionally foldable;
    - a first lower ledge positioned between the first panel and the third panel of the five panels and separated from the second panel of the five panels by a first aperture; and
    - a second lower ledge positioned between the third panel and the fifth panel of the five panels and separated from the fourth panel of the five panels by a second aperture,
  - wherein the rectangular sheet is folded into a flat inclusion configuration, said flat inclusion configuration comprising:
    - an inner wall of the lighter holder, said inner wall comprising the first and fifth panel of the five panels, wherein the first panel is overlapped and adhered to the fifth panel;
    - a rectangular portion comprising the inner wall and the third panel of the five panels, wherein the third panel overlaps the inner wall;
    - a first pair of wings extending from the rectangular portion, said first pair of wings comprising the second and fourth panels of the five panels, wherein the second and fourth panels are each folded outwards; and
    - a second pair of wings extending from the rectangular portion, said second pair of wings comprising the first and second lower ledges, wherein the first and second lower ledges are each folded outwards.

2. The package of claim 1, wherein the first panel has an adhesive on one surface thereof.

3. The package of claim 2, wherein the fifth panel comprises at least one strip of adhesive disposed on a surface of the fifth panel opposite the first panel.

4. The package of claim 1, wherein the flat inclusion configuration is capable of opening into an expanded configuration, said expanded configuration comprising:
- an outer wall opposite the inner wall, said outer wall comprising the third panel;
- a pair of side walls comprising the second and fourth panels folded outward; and
- a support comprising the first and second lower ledges folded inward for supporting a lighter.

5. The package of claim 1, wherein the five discrete panels are of approximately equal width.

6. The package of claim 1, wherein the first and second apertures are pentagonal.

7. The package of claim 1, wherein the rectangular sheet is paperboard.

8. The package of claim 1, wherein the rectangular sheet is plastic.

9. The package of claim 3, wherein the strip of adhesive is two-sided adhesive tape.

* * * * *